US007299532B2

(12) United States Patent
Criacci

(10) Patent No.: US 7,299,532 B2
(45) Date of Patent: Nov. 27, 2007

(54) METHOD FOR THE CREATION OF CLEARANCE HOLES

(76) Inventor: Massimo Criacci, Via Tiberina Km, 9, 200, I-00060 Riano (RM) (IT)

( * ) Notice: Subject to any disclaimer, the term of this patent is extended or adjusted under 35 U.S.C. 154(b) by 237 days.

(21) Appl. No.: 10/505,430

(22) PCT Filed: Mar. 7, 2003

(86) PCT No.: PCT/IT03/00140

§ 371 (c)(1),
(2), (4) Date: Aug. 24, 2004

(87) PCT Pub. No.: WO03/079856

PCT Pub. Date: Oct. 2, 2003

(65) Prior Publication Data

US 2005/0172474 A1 Aug. 11, 2005

(30) Foreign Application Priority Data

Mar. 22, 2002 (IT) ..... RM2002A0160

(51) Int. Cl.
*B23P 13/04* (2006.01)

(52) U.S. Cl. ..... 29/557; 29/558; 29/525.01; 29/525.11

(58) Field of Classification Search ..... 29/557, 29/558, 525.01, 525.11, 433
See application file for complete search history.

(56) References Cited

U.S. PATENT DOCUMENTS

| | | | | |
|---|---|---|---|---|
| 2,045,025 | A * | 6/1936 | Richardson | 29/417 |
| 2,188,833 | A * | 1/1940 | Dennison | 59/35.1 |
| 3,165,750 | A * | 1/1965 | Tell | 29/600 |
| 3,228,094 | A * | 1/1966 | Stanback et al. | 29/876 |
| 3,438,405 | A * | 4/1969 | Scheffer | 140/93 R |
| 4,006,525 | A * | 2/1977 | Hennenfent et al. | 29/558 |
| 4,722,819 | A * | 2/1988 | Lundsager | 264/177.11 |
| 6,023,836 | A * | 2/2000 | Matsuoka et al. | 29/557 |
| 6,685,285 | B1 * | 2/2004 | Fromme et al. | 312/220 |
| 6,792,661 | B1 * | 9/2004 | Fromme et al. | 29/416 |
| 7,062,836 | B1 * | 6/2006 | Sorgi | 29/525.01 |
| 2003/0081995 | A1 * | 5/2003 | Acciacca | 403/353 |

FOREIGN PATENT DOCUMENTS

| | | | |
|---|---|---|---|
| CH | 518 484 | A | 3/1972 |
| DE | 43 35 252 | A | 4/1995 |
| DE | 298 01 843 | U1 | 5/1998 |
| EP | 46022 | A2 * | 2/1982 |
| FR | 2 256 011 | A | 7/1975 |
| GB | 764 392 | A | 12/1956 |
| GB | 2 275 861 | A | 9/1994 |

* cited by examiner

*Primary Examiner*—Essama Omgba
(74) *Attorney, Agent, or Firm*—Breiner & Breiner, LLC

(57) ABSTRACT

A method to join different materials through the creation of holes which allow entry of stay bolts is described. The method includes making slots on the plane of any material, the depth of these slots being equal to half the thickness of the plane, plus the length of the radius of the stay bolt or stud to be entered, plus a tolerance margin. The slots have a length as required by its end use and are made on two or more sides of the plane, in an alternate manner, so that the slot made on one side overlaps by a few millimeters the slot made on the opposite side creating a space for the passage of a stay bolt or stud that serves as the anchorage for the various pieces that make up an object to be realized.

4 Claims, 4 Drawing Sheets

METHOD FOR THE CREATION OF CLEARANCE HOLES

TECHNICAL FIELD

This invention relates to a method to join together even different material through the creation of clearance holes allowing the entry of stay bolts.

BACKGROUND OF ART

It is common knowledge that the creation of a number of objects quite often entails the recourse to junctions by means of tongue and groove joint pins, eccentric joint pins, and L-shaped elements, made of metal and other materials, adhesives, and so on.

The solutions outlined above have been adopted worldwide since time immemorial, even though they are often inadequate from an aesthetic point of view and, sometimes, they offer a poor resistance, particularly to transverse stresses.

Besides, these solutions do not allow a great freedom of junction among the parts, particularly when one wants to join together parts with angles other than right angles.

FUNDAMENTALS OF INVENTION

The subject of this invention is a method to join together even different materials through the creation of clearance holes allowing the entry of stay bolts.

According to this invention, slots are made on the plane of any material. The depth of these slots is equal to half the thickness of the plane, plus the length of the radius of the stay bolt or stud to be entered, plus a tolerance margin.

The slots have the required length and are made on two or more sides of the plane, in an alternate manner, so that the slot made on one side overlaps by a few millimeters the slot made on the opposite side, creating in such a way the space for the passage of a stay bolt and stud that serves as the—anchorage for the various pieces that make up to object to be realized.

Therefore, according to the method concisely described above, one may create seats of unlimited length for the passage of stay bolts or studs, while the thickness of the piece where the slots are made is determined exclusively by the depth that the tool being used may reach.

The detailed description provided below may allow an improved understanding of what has been briefly said until now by making reference to the attached drawings, where:

DESCRIPTION OF INVENTION

Figure 3:
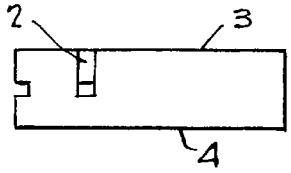
FIG. 3 shows a cross section of a slot made according to this invention.
Figure 1:
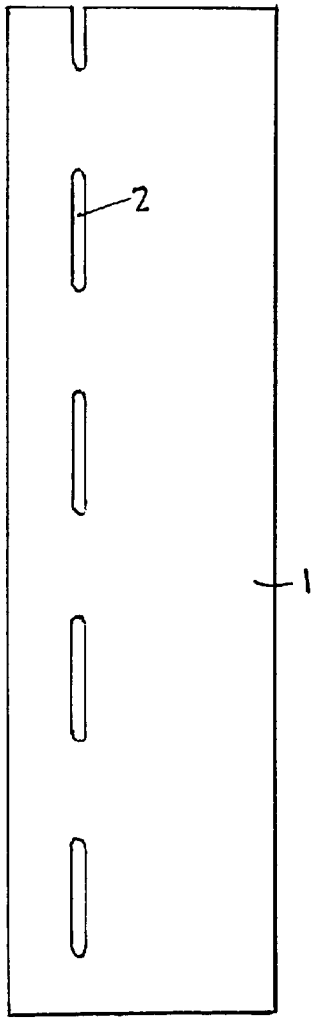
FIG. 1 shows the front view of a rectangular element worked according to the method of this invention.
Figure 2:
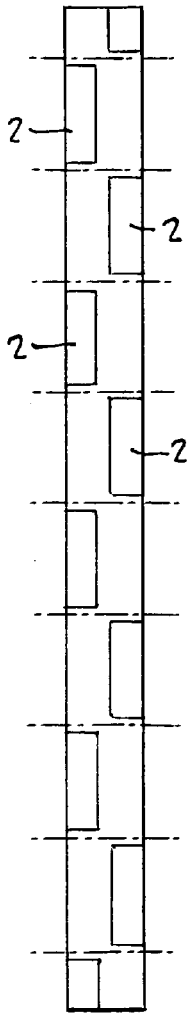
FIG. 2 shows a schematic view of how the slots are made on both sides of the part.
Figure 4:
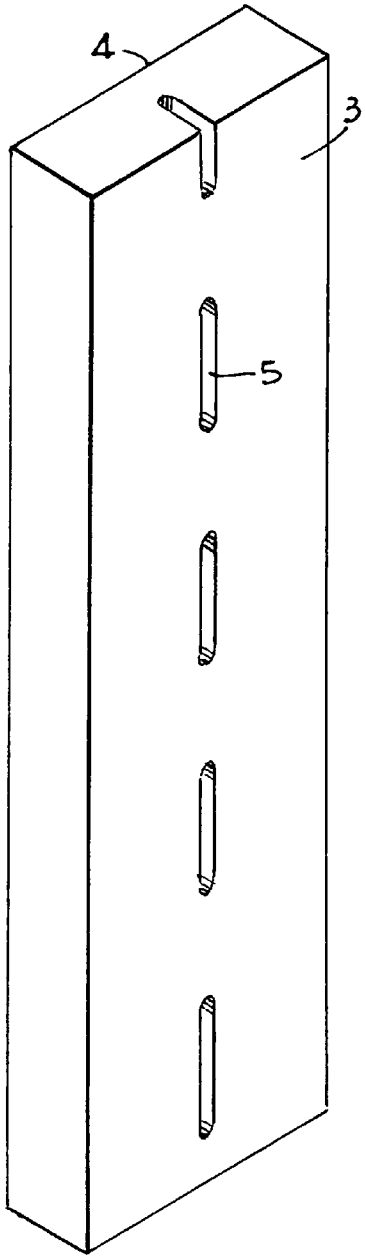
FIG. 4 shows an axonometric view of a part worked according to this invention.
Figure 5:
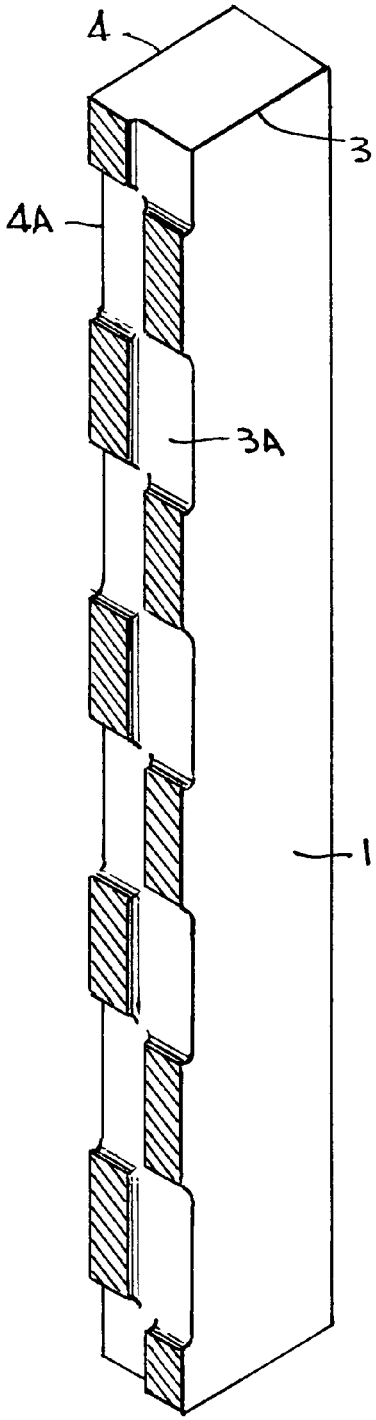
FIG. 5 shows a section axonometric of a part worked according to this invention.
Figure 6:
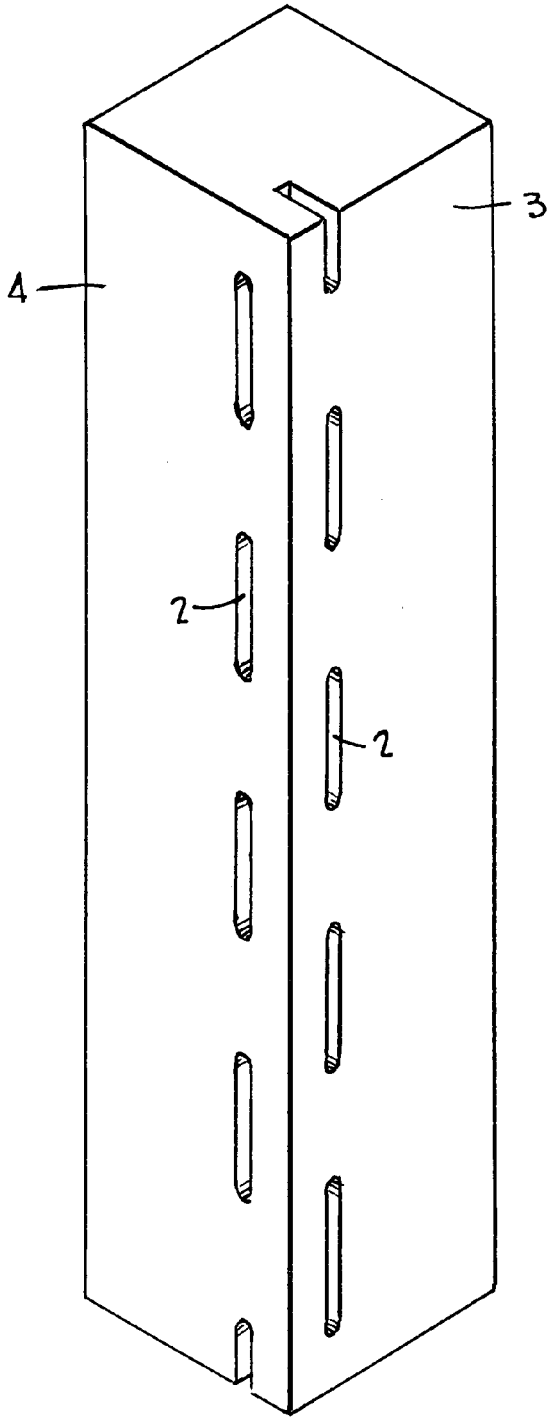
FIG. 6 shows an axonometric view of a part worked on an angle according to this invention.
Figure 11:
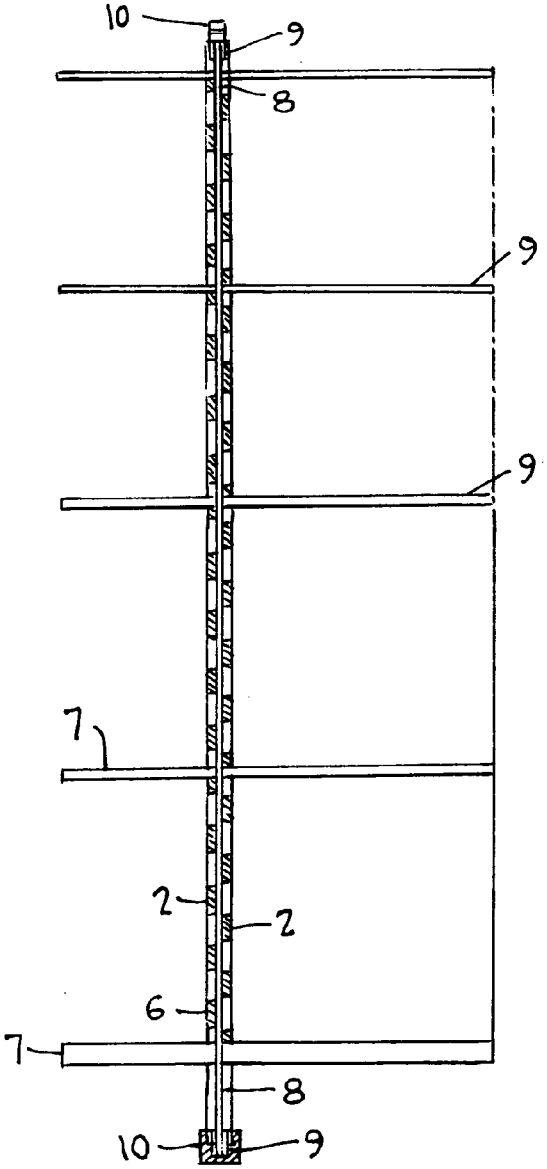
FIG. 11 shows a top view of the bookcase referred to in FIG. 8.
Figure 7:
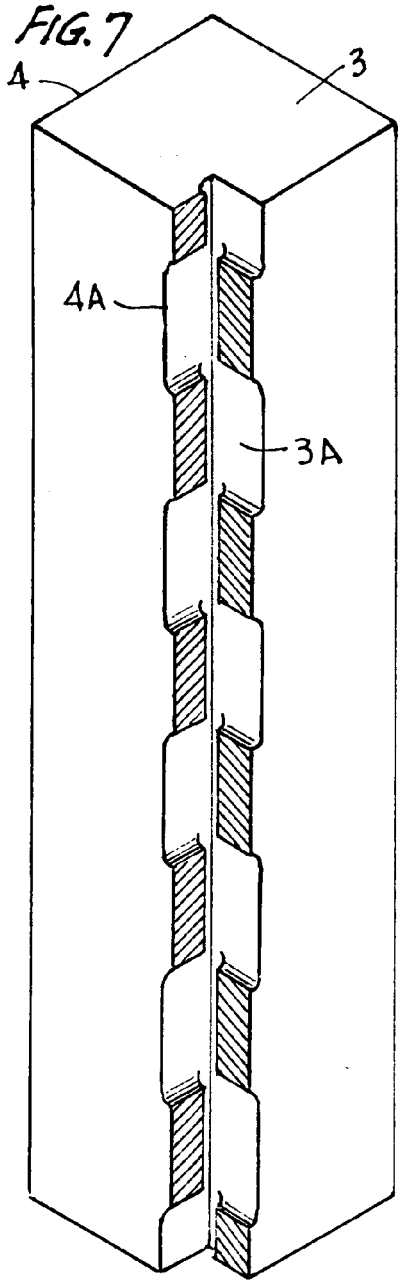
FIG. 7 shows a section axonometric of a part worked on an angle according to this invention.
Figure 10:
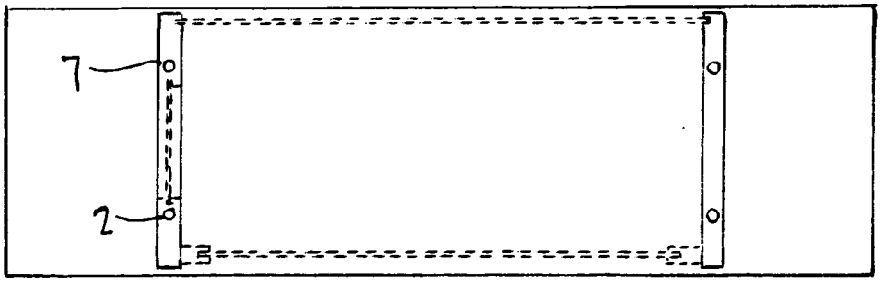
FIG. 10 shows a front section view of the bookcase referred to in FIG. 8.
Figure 9:
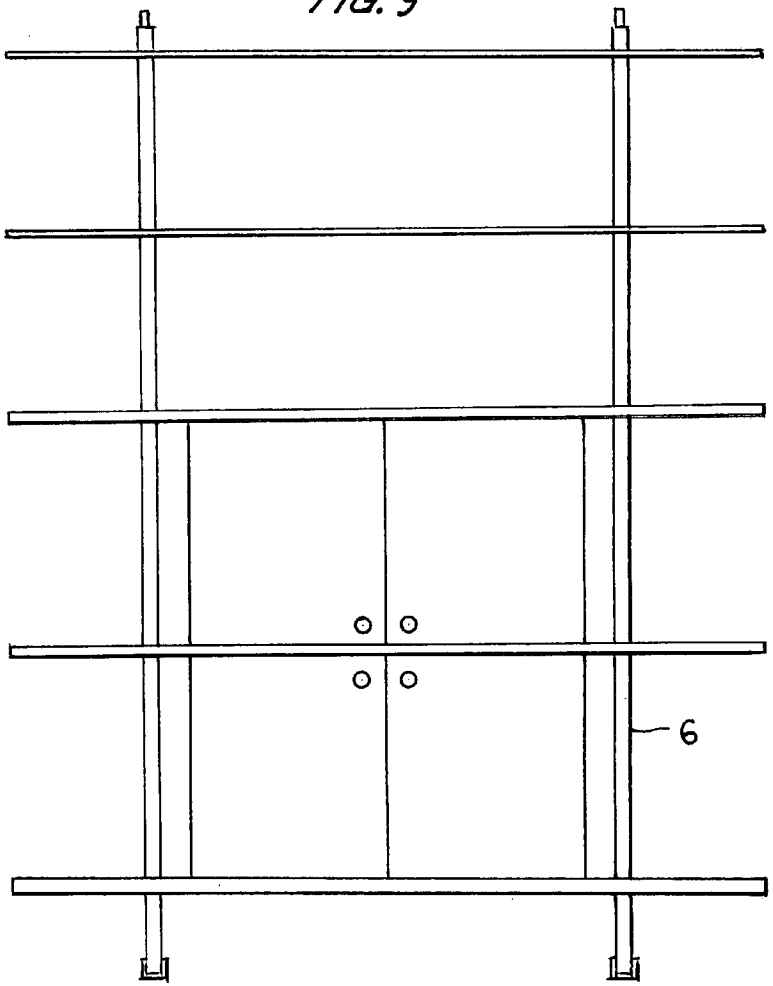
FIG. 9 shows a front view of the bookcase referred to in FIG. 8.
Figure 8:
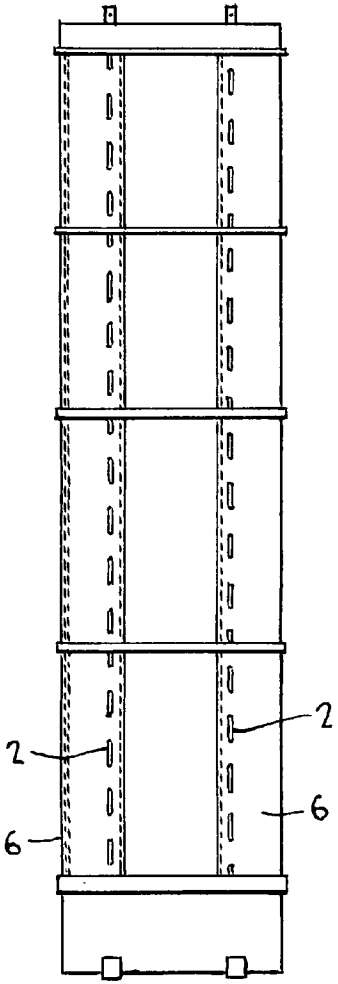
FIG. 8 shows a side view of a bookcase realized with a part worked according to this invention.

With reference to these figures, the method for creating clearance holes according to this invention is based on the realization, on two or more sides of an element (1), for instance a wooden standard to be used in a bookcase, of a series of slots (2) made alternatively in succession on side (3) and on the opposite side (4) of the element (1), along an axis, in such a way as to create a hole that is the result of the removal of material (3*a*), taken off from side (3) and the removal of material (4*a*) taken off from the opposite side (4) (FIGS. 5-7). The clearance hole has a length as required and a diameter which is based on half the thickness of the part being worked, plus the radius of the stay bolt or cable, plus the tolerance of the materials that varies in relation to the materials themselves.

The clearance hole(s) may be used in the assembly of the parts that make up a piece of furniture such as, for instance, in the realization of a bookcase for the passage of stay bolts that allow to make the side of the bookcase an integral part of the shelves, without having to resort to the traditional anchoring methods described above.

For instance, with reference to FIGS. 8, 9, 10, and 11, it may be easily understood how the realization of the bookcase being shown is extremely simplified by the presence along the standards (6) of the slots (2) that allow the passage of the stay bolt (8).

The stay bolt (8) allows the various sections of the standards (6) to form an integral part supporting the shelves (9) and to reach the required height even though, at least in the front part, nothing is visible. Furthermore, the sturdiness of the system that is the subject matter of this invention is determined both by the fact that, being the stay bolts (8) accommodated inside the structure, they are protected from any impact, and the fact that their position may not change by chance depending on the stresses and size of the structure.

Obviously, in order to see that the stay bolts (8) carry out their function in the best possible manner, they shall be preferably provided with threaded ends for screwing terminals (10) which are to allow the adjustment of the tension of the stay bolts (8), even in relation to the material used to realize the object or, at least, the structure, but also in relation to the weight to be sustained and the use the object is intended for.

As previously pointed out. FIGS. 6 and 7 clearly show that a clearance hole may be created on an angle of the piece being worked, making slots (2) close to the angle always according to the arrangements described above.

In case of holes to be created in elements having a considerable width, for instance beams, the slots may be realized alternatively on each one of the four sides in such a way as to ensure the continuity in the material being removed and, therefore, the creation of the hole for the passage of the stud or reinforcement. A wooden beam for the falsework of a roof may represent an example of such an application. It is clear that the possibility of creating clearance holes on the pieces to be assembled in order to accommodate cables or stay bolts of any type and material allows the greatest possible freedom in the realization, doing away with the design-related limitations that are currently imposed by the customary means of aggregation and assembly such as shelves, adhesives, tongue and groove joint pins, and so on.

The recourse to the aforementioned method, for instance, makes it both feasible and easy to realize an orientation in the assembly of the standard with respect to the plane of the shelf that is above or below 90°, allowing in such a way the realization of bookcases or pieces of furniture where the design is not constrained by a right angle.

A further advantage that results from the application of the aforementioned method is that, being realizable on any material, including for instance Perspex, metal, wood and such artificial materials as plastics, it allows a joint to be made with no resulting problem due to the different materials being used.

It is evident that even though a likely application of the method was suggested with reference to the realization of a bookcase, this should not be construed as a limitation to the likely fields of use of this method as it was merely provided as an example.

The invention claimed is:

1. A method for creating clearance holes in a part being worked having a first side and a second side which are either opposite or adjacent, comprising making a series of slots alternatively in succession and along an axis on said first side and said second side of the part, once on the first side and once on the second side of said part, in such a way so as to create a continuity between material removed in providing the slots on the first side and on the second side and, by removal of the material, the slots provide therein a clearance hole at a center of thickness of the part in which the slots are made, wherein said clearance hole allows for continuous passage of a stay bolt or cable, wherein the clearance hole has a length as required for said part, while depth of the slots is half of a thickness of the part being worked, plus a radius of the stay bolt or the cable, plus tolerance of respective materials, and varies in relation to the materials themselves.

2. The method according to claim 1, wherein when slots are created on adjacent sides of the part, said clearance hole is located close to an angle provided by the adjacent sides.

3. The method according to claim 1, wherein each end of the stay bolt or the cable that acts as a stay bolt and is accommodated within the clearance hole is threaded so that a terminal joining of parts crossed by the stay bolt or the cable may be screwed on each side.

4. The method according to claim 1, further comprising providing said slots in more than one part wherein each part is made of a different material, and each said part can be joined together by said stay bolt or said cable.

* * * * *